US006598684B2

(12) United States Patent
Watanabe

(10) Patent No.: US 6,598,684 B2
(45) Date of Patent: Jul. 29, 2003

(54) IMPACT POWER TOOLS

(75) Inventor: Masahiro Watanabe, Toyohashi (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/992,370

(22) Filed: Nov. 16, 2001

(65) Prior Publication Data

US 2002/0060082 A1 May 23, 2002

(30) Foreign Application Priority Data

Nov. 17, 2000 (JP) ..... 2000-350438
Nov. 22, 2000 (JP) ..... 2000-356335

(51) Int. Cl.[7] ..... B25B 23/14

(52) U.S. Cl. ..... 173/2; 173/176; 318/281; 73/862.23

(58) Field of Search ..... 173/176, 180, 173/181, 2, 109; 318/281, 139, 434; 73/862.21, 862.23

(56) References Cited

U.S. PATENT DOCUMENTS

| | | | | | |
|---|---|---|---|---|---|
| 4,375,120 | A | * | 3/1983 | Sigmund | 173/176 |
| 5,277,261 | A | | 1/1994 | Sakoh | 173/176 |
| 5,284,217 | A | * | 2/1994 | Eshghy | 173/176 |
| 5,289,885 | A | | 3/1994 | Sakoh | 173/2 |
| 5,361,852 | A | * | 11/1994 | Inoue et al. | 173/176 |
| 5,831,402 | A | * | 11/1998 | Yang | 318/281 |
| 5,898,598 | A | * | 4/1999 | Szwast et al. | 73/862.23 |
| 6,378,623 | B2 | * | 4/2002 | Kawarai | 173/2 |

FOREIGN PATENT DOCUMENTS

| | | |
|---|---|---|
| JP | 7-314344 | 12/1995 |
| JP | 10-180643 | 7/1998 |
| JP | 2000-210877 | 8/2000 |

OTHER PUBLICATIONS

US patent application No. 09/811,370, filed Mar. 16, 2001.

* cited by examiner

*Primary Examiner*—Scott A. Smith
(74) *Attorney, Agent, or Firm*—Orrick, Herrington & Sutcliffe LLP

(57) ABSTRACT

Power tools (1) may include a drive source (22). A device for generating an elevated torque, such as a hammer (4) and anvil (2), may be operably coupled to the drive source. Preferably, a sensor (30) detects when the hammer has begun to strike the anvil and generate the elevated torque. A control device (38) communicates with the sensor and the drive source and communicates signals to the control device when the hammer has begun to strike the anvil and generate the elevated torque. Preferably, the control device determines whether the when the hammer has begun to strike the anvil and generate the elevated torque either (1) before a fastener has reached a seated position against a workpiece or (2) after the fastener has reached the seated position against the workpiece. Thereafter, the control device only controls the operation the drive source based upon signals generated by the sensor after the fastener has reached the seated position against the workpiece. The power tools may optionally also include a setting device (34) for setting at least one operating mode and the setting device is preferably coupled to the control device. Further, a switch (48) may be provided to switch the operating mode set by the setting device to a predetermined operating mode, which is preferably stored in the control device. The control device preferably drives the drive source in the predetermined operating mode when the switch is operated according to a predetermined condition, and the control device drives the drive source in the operating made set by the setting device when the switch is not operated according to a predetermined condition.

18 Claims, 7 Drawing Sheets

IMPACT POWER TOOLS

This application claims priority to Japanese patent application serial numbers 2000-350438 and 2000-356335, the contents of which are hereby incorporated by reference.

BACKGROUND OF THE INVENTION

1. Field of the Invention

The present invention relates to power tools and more particularly, relates to power tools, such as impact wrenches and impact screwdrivers, having a drive source that is controlled by a pre-set operating program (operating mode).

2. Description of the Related Art

Known impact power tools have a drive source that is controlled by a pre-set or predetermined operating program (operating mode) in order to facilitate the tightening operation and to provide uniform work quality. For example, known impact wrenches and impact screwdrivers can be operated according to such operating programs.

Further, known impact tightening tools generally include a drive sou such as an electric motor or a pneumatic motor, that rotates a hammer in order to strike an anvil and generate an elevated torque. This elevated torque may be utilized to securely tighten a fastener, such as a screw, a nut or a bolt. Generally speaking the hammer is allowed to slip and freely rotate with respect to the anvil when a predetermined amount of torque is exerted.

Thus, the fastener can be driven with a relatively light load until a head potion of the fastener contacts the workpiece (i.e., before the fastener becomes seated against workpiece), because the hammer will continuously rotate the anvil in order to continuously tighten the fastener using a relatively low torque. However, as the fastener is driven further and the hammer exerts more than a predetermined amount of force against anvil, because the head of the fastener has contacted the workpiece (i.e., after the fastener has become seated against the workpiece), the hammer will begin to slip and rotate freely. Therefore, the hammer will impact the anvil after rotating by a predetermined angle. By the repetition of the slipping and impacting action, the anvil will rotate a small amount each time the hammer impacts the anvil and the fastener can be tightened to an appropriate torque.

In this type of impact tightening tool, the tightening torque may be determined based upon the number of times that hammer impacts or strikes the anvil. Therefore, if the number of impacts between the hammer and anvil is too high the tightening torque applied to the fastener will be too great and may possibly damage the fastener. In order to prevent and anvil, and automatically stops the drive source of the hammer when a pre-determined number of impacts have been detected (i.e., the tightening torque is determined by the number of impacts). Thus, a sensor is utilized to detect impacts between the hammer and anvil and a microprocessor counts the number of impacts. When the number of counted impacts reaches a preset number, the drive source is automatically stopped to prevent the fastener from being overtightened.

In the alternatives the drive source can be automatically stopped after a predetermined time interval or period has elapsed after the detection of the first impact of the hammer striking the anvil. Therefore, application of excessive torque is avoided and damage to the fastener can be prevented.

SUMMARY OF THE INVENTION

However, if the fastener has a burr in its threads, it may be necessary to utilize a tightening force that exceeds the predetermined amount of torque in order for the fastener to reach the seated position. As a result, if the known tightening techniques are utilized, the drive source may be prematurely stopped before, the fastener has reached the seated portion. Consequently, if a burr is present, insufficient tightening torque may be applied to the fastener and/or the drive source may be stopped before the fastener reaches the seated position. Thus, known tightening techniques may not adequately tighten a fastener having a burr or other imperfection within the fastener threads.

It is, accordingly, one object of the present teachings to provide improved power tools that can adequately and appropriately tighten fasteners having a burr or other imperfection according to a desired tightening torque.

For example, in one aspect of the present teachings, impact tightening tools are taught that are capable of tightening fasteners using a sufficient or adequate tightening torque, even if a burr is present on the fastener. Therefore, even if the hammer impacts or strikes the anvil before the fastener has reached the seated position, the power tool can adequately compensate for this additional torque that is applied to the fastener without applied an excessive torque to the fastener.

Thus, in one embodiment of the present teachings, impact tightening tools may include a hammer that is allowed to slip and rotate freely with respect to an anvil when a force exceeding a predetermined magnitude is applied between the hammer and anvil. Preferably, the hammer may impact or strike the anvil after the hammer has slipped or rotated by a predetermined angle. The impact then causes the anvil to rotate by a small amount and tighten the fastener. Such impact tightening tools may also include a drive source, such as an electric or pneumatic motor, and a control device, such as a microprocessor, for controlling the operation of the drive source. The control device preferably determines whether the hammer has begun to impact the anvil either before or after the fastener has reached the seated position. If the control device determines that the impacts have began after the fastener has reached the seated position, the control device will automatically stop the drive source when the pre-determined torque has been applied.

On the other hand, if the control device determines that one or more impacts (i.e., the hammer striking the anvil) have occurred before tho fastener is seated against the workpiece, the control device will ignore such impacts for the purpose of determining the amount of torque that has been applied to the fastener. Instead, the control device will begin to count the number of impacts (i.e., the hammer striking the anvil) after the control device determines that the fastener has reached the seated position against tho workpiece. Thereafter, the fastener can be tightened with the desired (or predetermined) torque, even if a burr or other imperfection is present on the fastener.

In the alternative, the control device can also determine or identify the first impact of the hammer striking the anvil after the fastener has reached the seated position and then start a clock or timer. If the control device determines that an impact (i.e., the hammer striking the anvil) occurred before the fastener is seated against the workpiece, the control device will not start the clock or timer. Thereafter, the control device can automatically stop the motor after a predetermined amount (or period) of time has elapsed in this mode, the predetermined amount of time corresponds to a predetermined amount of torque and the predetermined amount of torque can be set by an operator (or other individual) before a particular tightening operation is begun.

Thus, the control device may be programmed, such that a desired amount of torque is centered into the control device before the tightening operation. The control device then converts the desired (or predetermined) amount of torque into an amount or period of time that the drive source (e.g., a motor) will continue to drive or rotate the hammer from the time that the first impact of the hammer striking the anvil has occurred after the fastener has reached the seated position.

In another aspect of the present teachings, when an impact between the hammer and anvil is detected, the control device preferably determines whether the impact has occurred before or after the fastener has reached the seated position. The drive source will be stopped at an appropriate timing when the first impact is identified that occurred after the fastener his reached the seated position. On the other hand, if the control device determines that the hammer has impacted or struck the anvil before the fastener has reached the seated position, e.g., due to a burr, the detected impact will not be utilized to determine when to stop the hammer drive source. Therefore, the fastener can be tightened to the desired tightening torque.

Optionally, a sensor may be provided to detect the impacts between the hammer and anvil. The sensor may communicate detected impacts to the control device and the control device may preferably utilize information concerning the detected impacts in order to control the operation of the drive source. If an oil pulse unit is utilize to generate elevated torque, instead of a hammer and anvil, the sensor may sense some characteristic (e.g., emitted sound) of the oil pulse unit that indicates the oil pulse unit is generating oil pulses. Again, this information may then be communicated to the control device and utilized The type of sensor that can be utilized with the present teachings is not particularly limited and may be any type of sensor capable of detecting impacts between the hammer and anvil. For example, the present teachings contemplate the use of accelerometers, which detect the acceleration of the hammer, proximity sensors, which detect the position of the hammer, and/or sound sensors (e.g., condenser microphones, piezoelectric materials, etc.), which detect impact sounds generated by the hammer striking the anvil (or oil pulses generated by an oil pulse unit).

In another embodiment of the present teachings, methods are taught for programming the control device in order to determine whether a detected impact occurred before or after the fastener has reached the seated position. For example, one representative method determines whether an impact has occurred within a predetermined period of time after the tightening operation has started. The predetermined period of time may be, e.g., an average time between the art of the tightening operation and the fastener reaching the seated position. If the impact is detected before the predetermined period of time has expired, of control device determines that the fastener has not yet reached the seated position.

In another representative method, a determination is made by utilizing the time interval between impacts. For example, the time interval between impacts generally becomes shorter after the fastener reaches the seated position. Naturally, if the time intervals between impacts increase or do not become closer in time, it is likely that the fastener has not yet reached the seated position and an elevated torque is being generated to rotate a fastener having a burr or other imperfection.

Thus, in another representative method, the determination is made by utilizing or monitoring a change in the time intervals between impacts. For example, the intervals between impacts after the fastener has reached the seated position typically decrease linearly. On the other hand, if the intervals between impacts increase, the control device will determine that the previous impact(s) occurred before the fastener reached the seated position.

In another embodiment of the present teachings, the control device may start a timer each time that the sensor detects an impact between the hammer and anvil. When the timer reaches a preset or predetermined time, the control device will automatically stop the drive source. However, the timer is preferably re-set to zero if the control device determines that one or more impact(s) between the hammer and anvil occurred before the fastener has reached the seated position. Thus, the control device can effectively ignore impacts that occur before the fastener has reached the seated position, because such impacts may have been caused by the fastener having a burr or other imperfection. Preferably, the drive source may be stopped after driving the fastener for a predetermined period of time after the control device has identified the first occurrence of an impact between the hammer and anvil after the fastener has reached the seated position. Therefore, the fastener can be adequately and appropriately tightened.

In another embodiment of the present teachings, the control device is preferably programmed to count the number of detected impacts of the hammer striking the anvil. For example, when the number of detected impacts reaches a predetermined or preset number, the drive source is automatically stopped. Generally speaking, tho amount of torque increases as the number of impacts increases. Thus, a desired amount of tightening torque can be selected before the tightening operation begins by pre-selecting the number of impacts between the hammer and the anvil before stopping the drive source (e.g., motor).

On the other hand, when the control device determines that the hammer has begun to impact or strike the anvil before the fastener has reached the seated position, the impact counter is reset to zero. Thus, the drive source can be stopped after the hammer impacts or strikes the anvil a preset or predetermined number of times after the fastener has actually reached the seated position. Therefore, the fastener can be adequately and appropriately tightened In another embodiment of the present teaching, power tools may have a drive source that is controlled according to a programmed operating mode. In one representative example, power tools may include a setting device that sets the operating mode. The setting device may be, e.g., one or more dials, which can be manually operated, or a remote control device. A selector switch may be provided to switch the operating mode, which was set by the setting device, to a predetermined operating mode. Further, the control device (e.g., a microprocessor) preferably can control the drive source according to the operating mode. For example, if the selector switch is set to a predetermined operating mode, the control device will drive the drive source according to the selected operating mode. On the other hand, if the selector switch is not set to a predetermined operating mode, the drive source will be driven according the operating mode that was set using the setting device.

Thus, such power tools may preferably include a selector switch, which switches the operating mode to a predetermined operating mode, and a setting device or setting means, which sets the operating mode. Further, the selector switch can be operated according to a predetermined condition or program in order to switch the operation of the power tool to one of the predetermined operating modes.

Therefore, the power tools can be switched in a certain operating mode (e.g., manual mode) without having to change the operating mode set in the electric power tool (e.g., auto-stop mode). Consequently, if this technique is utilized in an impact tightening tool, the power tool can be temporarily switched to a manual mode by operating the selector switch if the drive source may possibly be stopped before the fastener has reached the seated position due to a burr or other imperfection of the fastener. Thereafter, the tightening operation can be continued in manual mode until the fastener reaches the seated position.

In another aspect of the present teachings, the control device preferably automatically returns to the operating mode set by the setting device as soon as the control device has finished driving the drive source in the operating mode selected by the selector switch. Thus, as soon as work in one selected operating mode is completed, the control device automatically returns to the operating mode set by the setting device. Therefore, continuation of work in the temporarily selected operating mode can be prevented.

In another embodiment of the present teachings, the selector switch may be a up switch that starts or energizes the drive source. Preferably, the control device switches to one operating mode when the start up switch is switched from the ON position to the OFF position in a predetermined condition, mode or program and then switched back again to the ON position within a predetermined time interval. If the start up switch is switched a the OFF position from the ON position, and if it is not then switched back to the ON position within the predetermined time interval, the operating mode set by the setting device will be utilized by the control device. Because the start up switch is used as the selector switch, an additional switch is not required to implement this function.

In addition, when the start up switch is switched to the OFF position and then switched back to the ON position within the predetermined time interval, the control device is switched to an operating mode stored in the control device (or in a memory that is in communication with the control device). If the start up switch is not switched back to the ON position within the predetermined time interval, the control device reverts to the operating mode set by the setting device. Consequently, if the start up switch is switched to the OFF position after the drive source has been driven in the pre-stored operating mode or program, tho control device reverts to the operating mode or program selected by the setting device. For example if the start up switch is not switched back to the ON position within a predetermined time interval, the control device will return to the operating mode or program selected by the setting device.

Preferably, the operating mode set by the setting device cannot be changed during normal operation. If the power tool is configured in this manner, accidental changes to the he mounted or installed in a location that can be accessed only after removing the battery pack. In the alternative, the operating mode can be set only by using special equipment (e.g., a radio control device or a remote control).

These aspects and features may be utilized singularly or in combination in order to make improved tightening tools, including but not limited to impact wrenches and impact screwdrivers. In addition, other objects, features and advantages of the present teachings will be readily understood after reading the following detailed description together with the accompanying drawings and the claims. Of course, the additional features and aspects disclosed herein also may be utilized singularly or in combination with the above-described aspects and feature.

DETAILED DESCRIPTION OF THE INVENTION

Figure 1:
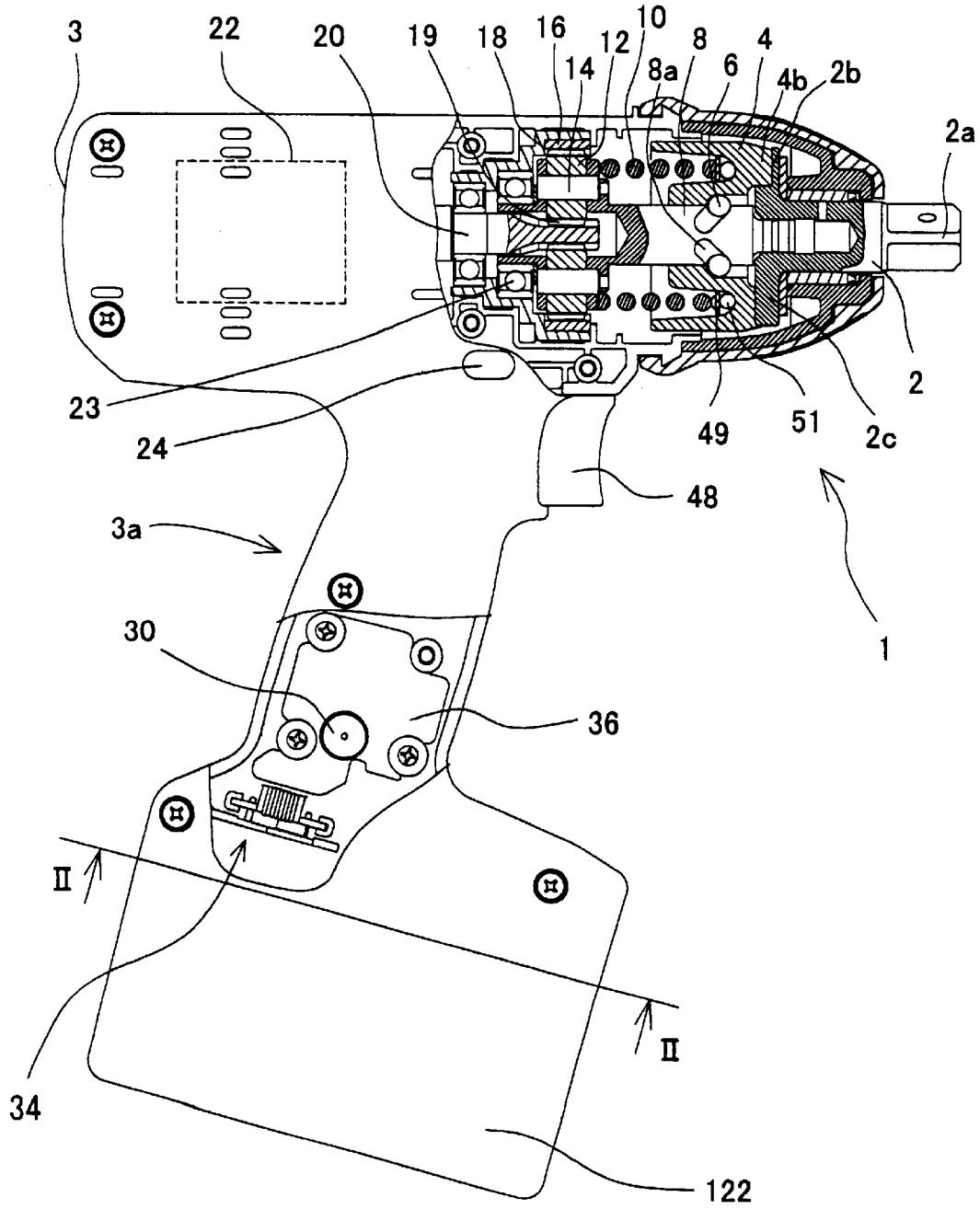
FIG. 1 is a side view, with parts broken away, of a tightening tool of the first representative embodiment.

Thus, in one embodiment of the present teachings, power tools are taught for tightening a fastener and may preferably include a drive source, such as a motor. Further, the power tool may include means for generating an elevated torque operably coupled to the drive source, which means may include a hammer and anvil or may include an oil pulse unit. A sensor preferably detects when the means for generating an elevated torque has begun to operate and generate the elevated torque. A wide variety of sensors may he utilized for this purpose.

A control device, such as a microprocessor or microcomputer, preferably communicates with the sensor and the drive source. Further, the sensor may communicate signals to the control device when the means for generating an elevated torque has begun to operate and generate the elevated torque. For example, the control device may determine whether the means for generating an elevated torque has begun to operate and generate the elevated torque either (1) before the fastener has reached a seated position against a workpiece or (2) after the fastener has reached the seated position against the workpiece. Thereafter, the control device may control the operation the drive source based upon signals generated by the sensor only after the fastener has reached the seated position against the workpiece For example, the control device may effectively ignore signals that are determined to have occurred before the fastener has become seated against the workpiece.

In another embodiment of the present teachings, the control device may start a timer when the control device determines that the means for generating an elevated torque has begun to operate and generate an elevated torque after the fastener has reached the sated position against the workpiece. Thereafter, the control device preferably stops the drive source when the timer reaches a pre-selected or pre-determined amount (or period) of time. Further, the control device preferably re-sets the timer to zero when the control device determines that the means for generating an elevated torque has begun to operate before the fastener has reached the seated position against the workpiece.

In another embodiment of the present teachings, the control device may start a counter to count the number of signals generated by the sensor after the fastener has reached the seated position. Thereafter, the control device may stop the drive source when the pre-determined number of signals have been counted. The pre-determined number of signals preferably corresponds to a desired amount of torque that the operator would like to apply to the fastener. In addition, the control device may preferably reset the counter to zero when the control device determines that the means for generating an elevated torque has begun to operate before the fastener has reached the seated position against the workpiece.

In another embodiment of the present teachings, the control device may determine that the fastener has reached the seated position against the workpiece by determining whether a first signal and a subsequent signal generated by the sensor occur within a predetermined interval (or period) of time. If the time between the detected signals is greater than the pre-determined interval (or period) of time, the control device preferably determines that the first signal occurred before the fastener has reached the seated position against the workpiece.

In another embodiment of the present teachings, the control device may control the drive source according to a selected or a pre-determined operating mode. Further, means may be provided for setting at least one operating mode coupled to the control device. Such setting means may be, e.g., dial switches (or dial selectors) or a remote control device (e.g., a device that communicates instructions to the control device by radio waves, infrared waves or other wavelengths).

A switch may be provided for changing the operating mode set by the setting means to the predetermined operating mode. Thereafter, the control device may drive the drive source in the predetermined operating mode when the switch is operated according to a predetermined condition. Further, the control device may drive the drive source in the operating mode set by the setting means when the switch is not operated according to the predetermined condition. In addition, the control device may automatically return to the operating mode set by the setting means after completing driving the drive source in the predetermined operating mode selected by the switch.

For example, the switch may be a startup switch (e.g., a trigger switch) that energizes the drive source. Thus, the control device may select the predetermined operating mode when the start up switch is switched from the ON position to the OFF position in a predetermined condition, and the start up switch is then switched back to the ON position again within a predetermined time period. In addition, the control device may select the operating mode set by the setting device when the start up switch is not switched back to the ON position within the predetermined time period after having been switched from the ON position to the OFF position.

In another embodiment of the present teachings, the control device may stop the drive source when impact sounds (e.g., the hammer striking the anvil or the oil pulse unit begins to generate an elevated torque) Are repeatedly detected by the sensor within a predetermined time interval. Optionally, the control device will not top the drive source unless a preset time has elapsed since detection of the repeated impacts within the predetermined time interval.

Each of the additional features and method steps disclosed above and below may be utilized separately or in conjunction with other features and method steps to provide improved power tools and methods for making and using the same. Detailed representative examples of the present teachings, which examples will be described below, utilize many of these additional features and method steps in conjunction. However, this detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not he necessary to practice the present teachings in the broadest sense, and are instead taught merely to particularly describe representative and preferred embodiments of the present teachings, which will be explained below in further detail with reference to the figures. Of course, features and steps described in this specification and in the dependent claims may be combined in ways that are not specifically enumerated in order to obtain other usual and novel embodiments of the present teachings and the present inventors contemplate such additional combinations.

First Detailed Representative Embodiment

FIG. 1 shows a first detailed representative embodiment of the present teachings. For example, impact wrench 1 may include motor 22 that is disposed within housing 3. Gear 19 is disposed on output shaft 20, which is coupled to motor 22. Gear 19 engages a plurality of planet gears 12 that arc rotatably mounted on pin 14. Internal gear 16 is disposed within internal gear case 18 and engages planet gears 12. The gears may reduce the driving speed of a tool bit (not shown). Further, pin 14 may be fixedly attached to a spindle 8, which is rotatably mounted within housing 3.

Spindle 8 may be rotatably driven by motor 22 using a reduction gear mechanism, which may comprise gears 12, 16, and hammer 4 is rotatably mounted on the spindle 8. A cam mechanism having a plurality of recesses 8*a* and bearings 6, which bearings 6 are disposed within recesses 8*a*, is interposed between hammer 4 and spindle 8. Recesses 8*a* are formed within spindle 8 in a V-shape and thus extend obliquely relative to the longitudinal axis of spindle 8. The cam mechanism permits hammer 4 to move by a predetermined distance along spindle 8 in the longitudinal direction. Compression spring 10 is interposed between hammer 4 and spindle 8 via bearing 51 and washer 49 so as to normally bias hammer 4 in the rightward direction of FIG. 1.

Anvil 2 is rotatably mounted on the forward end of housing 3 and cooperates with hammer 4 to generate a tightening torque. Forward portion 2*a* of anvil 2 may have a polygonal cross-section that is adapted to mount the tool bit (not shown). The tool bit may then engage the fastening device (fastener) in order to drive the fastening device into the workpiece. The rear end of anvil 2 preferably has two protrusions 2*b*, 2*c* that radially extend from anvil 2. The forward portion of hammer 4 also preferably has two protrusions 4*b*, 4*c* that radially extend from hammer 4. Protrusions 2*b*, 2*c* and protrusions 4*b*, 4*c* are adapted to abut each other.

When the fastening device is tightened using a relatively low torque, the force transmitted from protrusions 4*b*, 4*c* to protrusions 2*b*, 2*c*, as well as the force applied to hammer 4 by spindle 8 via bearings 6, is relatively small. Thus, hammer 4 continuously contacts anvil 2 due to the biasing force of spring 10. Because the rotation of spindle 8 is continuously transmitted to anvil 2 via hammer 4, the fastening device is continuously tightened However, when the tightening torque becomes larger, the force transmitted from protrusions 4*b*, 4*c* to protrusions 2*b*, 2*c*, as well as the force applied to hammer 4 by spindle 8 via bearings 6, becomes larger. Thus, a force that urges hammer 4 rearward along spindle 8 becomes larger. When the force applied to anvil 2 by hammer 4 exceeds a predetermined force (i.e. a threshold force), hammer 4 moves rearward and protrusions 4*b*, 4*c* disengage from protrusions 2*b*, 2*c*. Therefore, hammer 4 will rotate idly relative to anvil 2 (i.e. no force is transmitted from hammer 4 to anvil 2 for a portion of the rotation). However, as protrusions 4*b*, 4*c* pass over protrusions 2*b*, 2*c*, hammer 4 moves forward due the biasing force of the spring 10. As a result, hammer 4 strikes or impacts anvil 2 after each rotation at a predetermined angle. By changing the operation of the tightening tool so that hammer 4 repeatedly strikes anvil 2, the torque applied to the fastening device increase as the number of impacts increases.

Next, the switches and other parts installed in handle portion 3*a* will be explained with reference to FIGS. 1 and 2. Specifically, FIG. 2 shows a view looking into the handle from the direction indicated by line II in FIG. 1 (i.e., from the bottom of the impact wrench 1), after battery pack 122 has been removed from impact wrench 1.

As shown in FIG. 1, main switch 48 for starting motor 22 and rotor rotation direction switch 24 for switching the direction of rotation of motor 22 are installed on handle 3*a*. Main switch 48 is preferably a trigger switch. In addition, setting device 34 is installed on the bottom of handle 3*a*. Setting device 34 may include, e.g., first setting dial 33 and second setting dial 35, as shown in FIG. 2. A scale of numerals 0 through 9 and a scale of letters A through F may be provided on first setting dial 33. Further, a scale of numerals 0 through 9 may be provided on second setting dial 35. In this representative embodiment, it is possible to set a time period after which motor 22 will be stopped, if an impact (i.e., hammer 4 striking anvil 2) has not been detected. This period of time can be set using setting dials 33 and 35. For example, the time period may be selected using the numerical value "X" set using first dial 33 and the numerical value "Y" set using second dial 35.

As a more specific representative example, when a numerical value "X" is set using first setting dial 33 and a numerical value "Y" is set using second setting dial 35, the time period T may be determined, e.g., by the equation: $[(X\times10)+Y]\times0.02$ seconds. On the other hand, if first setting dial 33 and second setting dial 35 are both set to "0," the manual operating mode will be selected and motor 22 will be continuously driven as long as main switch 48 is switched to the ON position, regardless of whether an impact has been detected or not. Furthermore, setting device 34 also can be utilized to set a desired tightening torque value. Therefore, control device can select an appropriate method for stopping motor 22 when the desired amount of torque has been applied to the fastener. For example, instead of stopping motor 22 after a predetermined period of time has elapsed the control device also could stop motor 22 after a predetermined number of impacts have been detected. Because the number of impacts also generally corresponds to the amount of torque applied to the fastener, this counting technique can also be advantageously utilized with the present teachings.

Figure 2:
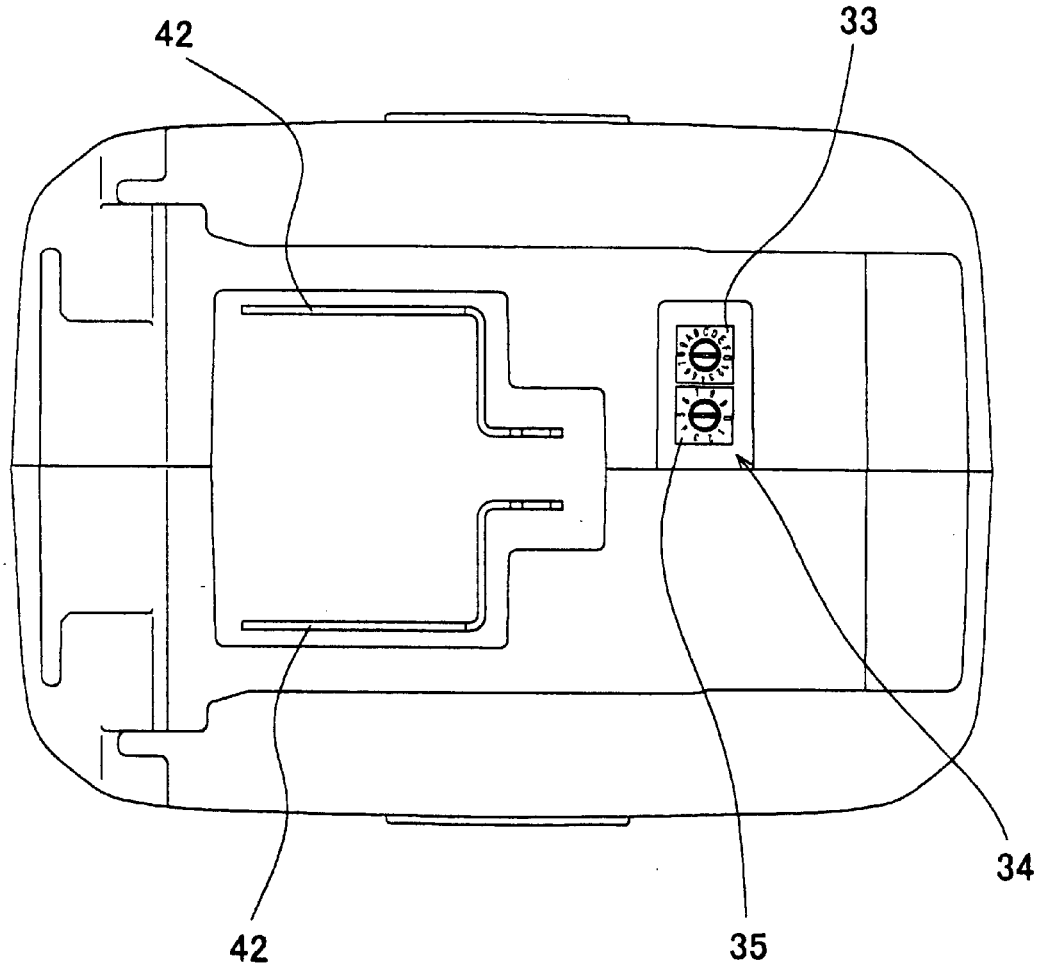
FIG. 2 shows a view looking into a battery mounting portion of the tightening tool of the first representative embodiment after the battery pack has been removed (view looking from the direction of line II shown in FIG. 1).

As indicated by FIGS. 1 and 2, the settings of each dial 33 and 35 can be changed only when battery pack 122 is removed from handle portion 3*a*, which will prevent accidental changes in the values set on the dials 33 and 35. In addition, as shown in FIG. 2, contact element 42 is disposed on the bottom of handle portion 3*a* so that contact element 42 will contact the corresponding electrical contact (not shown) of battery pack 122.

Further, control substrate 36 may be mounted within the bottom of handle portion 3*a*, as shown in FIG. 1. Microcomputer 38, switching circuit 114 and other electric parts can be mounted on control substrate 36. Control substrate 36 may be, e.g., a printed circuit board. A sound receiver 30 (e.g., a piezoelectric buzzer) that is capable of detecting impact sounds generated when hammer 1 strikes anvil 2 also can be mounted on control substrate 36.

Figure 3:
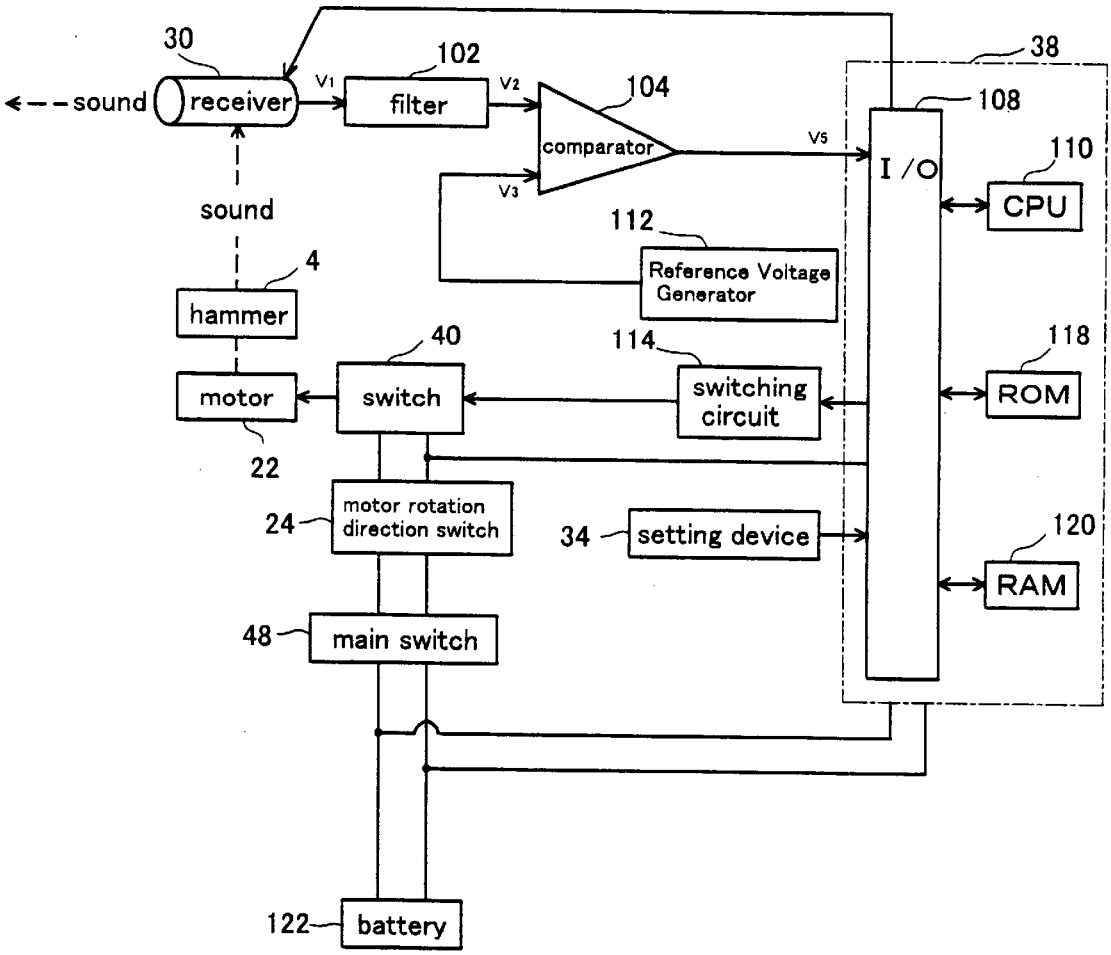
FIG. 3 is a block diagram showing a representative circuit for use with the first representative tightening tool.

A representative control circuit (control device) for operating impact wrench 1 is shown in FIG. 3. Generally speaking, the control circuit includes sound receiver 30 and microcomputer 38 mounted on control substrate 36. Microcomputer 38 may preferably include, e.g., central processing unit (CPU) 110, read only memory (ROM) 118, random access memory (RAM) 120 and input/output port (I/O) 108, all of which may be connected as shown in FIG. 3 and may be, e.g., integrated onto a single chip. ROM 118 may preferably store one or more control programs for operating impact wrench 1. For example, ROM 118 may include a program for stopping the motor 22 after a certain number of impacts (between hammer 4 and anvil 2) have been detected by sound receiver 30.

Sound receiver 30 is preferably coupled via filter 102 to one terminal of comparator 104. Voltage V3 from reference voltage generator 112 is input to the other terminal of comparator 104. The out voltage from comparator 104 is coupled to microcomputer 38. The output voltage preferably represents impacts (i.e., between hammer 4 and anvil 2) detected by sound receiver 30.

Battery pack 122 is coupled to microcomputer 38 and is further coupled to motor 22 via main switch 48, motor rotation direction switch 24 and switch 4(1. Switching circuit 114 couples switch 40 to microcomputer 38. Preferably, switch 40 is turned ON and OFF by an output signal from microcomputer 38. Furthermore, microcomputer 38 is also coupled to setting device 34, which includes dials 33 and 35.

When sound receiver 30 detects an impact sound, sound receiver 30 may generate a signal V1. Low frequency noise is filtered from the signal V1 by the filter 102 mid signal V2 is coupled to comparator 104. If signal V2 is greater than reference voltage V3, comparator 104 will change its output state, thereby generating a pulse wave. The pulse wave output from comparator 114 is coupled to microcomputer 3. Thereafter, microcomputer 38 preferably recognizes the pulse wave as a detected impact between hammer 4 and anvil 2. The use of the detected impact in the operation of impact wrench 1 will be further described below.

Figure 4:
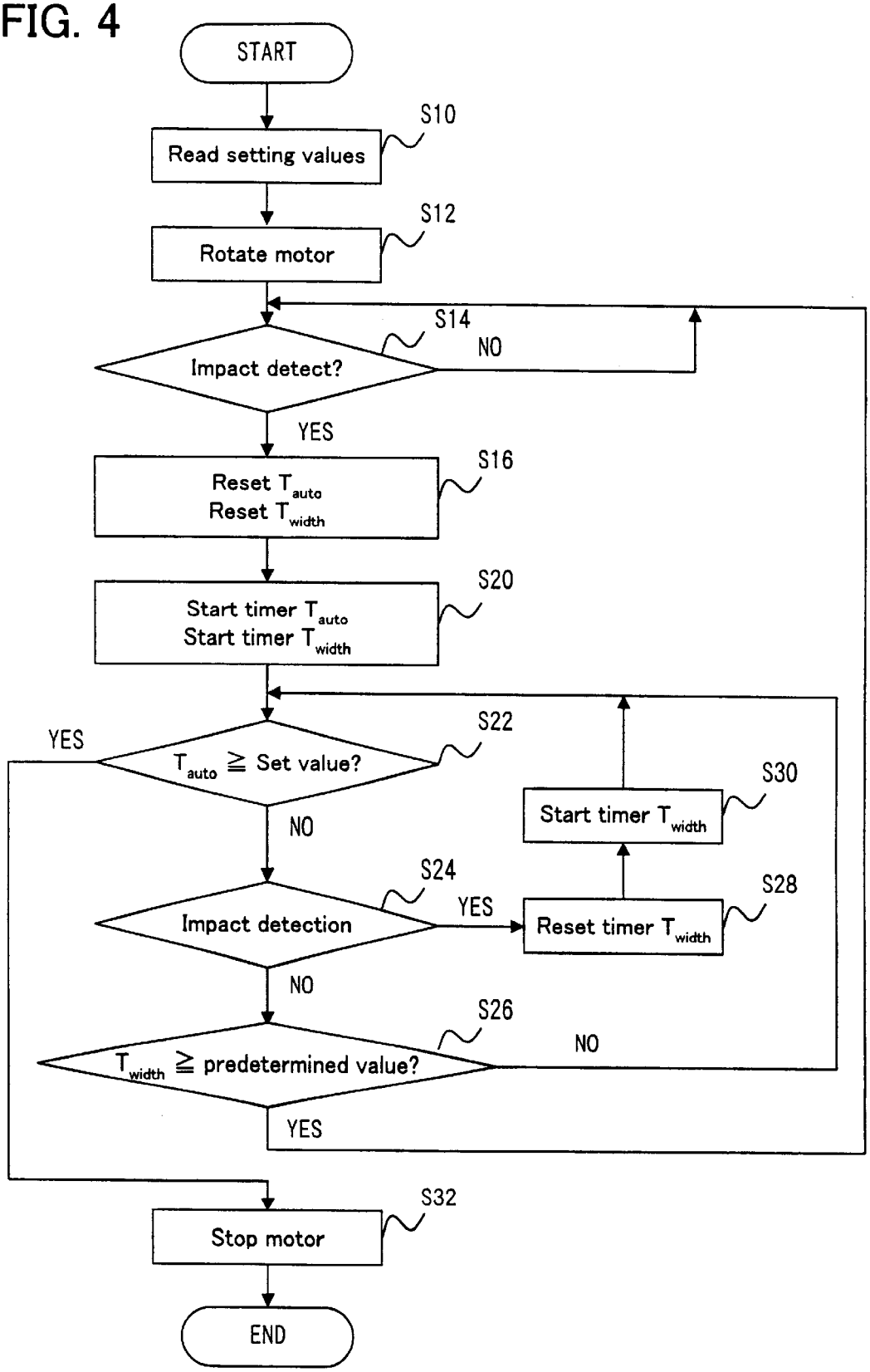
FIG. 4 shows a flowchart that explains the operation of the tightening tool of the first representative embodiment.

FIG. 4 shows a representative method for operating microcomputer 38 in order to tighten a fastener (fastening device) using impact wrench 1. That is, FIG. 4 is a flowchart of a portion of the process or program executed by microcomputer 38 during a tightening operation. In order to tighten a fastener using impact wrench 1, a fastener (e.g., a nut or bolt) is placed in a tool bit (not shown) coupled to anvil 2. Then, main switch 48 is switched or actuated to the ON position and microcomputer 38 will control the rotation of motor 22 in accordance with the operating mode currently being utilized.

For example, when main switch 48 is switched to the ON position, microcomputer 38 may first read the setting values (i.e., numerical value "XY") currently set on setting device 34 (step S10). As noted above, the time period between detection of an impact sound and stopping the motor 22 can be set utilizing the numerical value "X" set on the first setting dial 33 and the numerical value "Y" set on the second setting dial 35. Therefore, when main switch 48 is switched to the ON position, microcomputer 38 first db the numerical value "XY" set on setting device 34, and calculates the interval of time (or the number of counted impacts) for stopping the motor 22 after detection of a first impact sound.

Thereafter, microcomputer 38 outputs a signal to switch 40 via switching circuit 114 in order to start the rotation of motor 22 (step S12). As a result, motor 22 will start rotating and the fastener will be tightened in the workpiece.

In step S14, microcomputer 38 determines whether hammer 4 has impacted or struck anvil 2 (i.e., whether an impact sound has been detected). For example, microcomputer 38 determines whether a pulse wave has been output the comparator 104. If an impact between hammer 4 and anvil 2 has not been detected (NO in step S14), step S14 is repeated until an impact between hammer 4 and anvil 2 is detected. That is, microcomputer 38 assumes a standby status with respect to this operation until the first impact between hammer 4 and anvil 2 is detected.

When the first impact between hammer 4 and anvil 2 is detected (YES in stop S14), timers $T_{auto}$ and $T_{width}$ are reset in step S16 and then started in step S20. $T_{auto}$ represents the period of period that motor 22 will be permitted to rotate until it is automatically stopped (naturally, if $T_{auto}$ has not been reset in the meantime). $T_{width}$ represents a time period for determining whether an impact detected in step S14 is an impact before or after the fastener has reached the seated position.

After starting the two timers in step S20, microcomputer 38 proceeds to step S22 and determines whether automatic stop timer $T_{auto}$ has exceeded the time period set using setting device 34 (i.e., the time $T_{set}$ calculated based upon the numerical value "XY" that was road in step S10). If automatic stop timer $T_{auto}$ has exceeded the set value (YES in step S22), motor 22 is stopped (step S32), based upon the assumption that the fastener has been sufficiently tightened to the appropriate torque. More specifically, microcomputer 38 preferably turns OFF switch 40 by stopping the signal being output to switch 40.

On the other hand, if automatic stop timer $T_{auto}$ has not exceeded the set value (NO in stop S22), microcomputer 38 then proceeds to determine whether a new impact between the hammer 4 and anvil 2 has been detected (step S24). If a new impact between the hammer 4 and anvil 2 has been detected (YES in step S24), timer $T_{width}$ is reset (step S28) and re-started (step S30). Then, microcomputer 38 returns to step S22. The set value ($T_{auto}$) in step S22 may be preferably about 1.0 second. The predetermined value ($T_{width}$) in stop S26 is preferably much shorter than the set value ($T_{auto}$) (e.g., about 0.1 second).

However, if a now impact between hammer 4 and anvil 2 has not been detected (NO in step S24) microcomputer 38 then determines whether timer $T_{width}$ has exceeded the predetermined value (step S26). That is, the predetermined value is compared to the time actually counted by timer $T_{width}$. Generally speaking, the predetermined value in step S26 is preferably set to be several times of the average interval between impacts after the fastener has reached the seated position.

As noted above the predetermined value may be set to 0.1 second, which is about 5 times the average interval (i.e., 0.02 second) between impacts after the fastener has reach the seated position. Therefore if timer $T_{width}$ has exceeded the predetermined value (e.g., about 0.1 second), because a new impact has not been detected after the predetermined time step S14 is determined to be an impact before the fastener has reached the seated position. Thus, the process will return to stop S14 in this case. The predetermined value of step 26, which is compared to the time counted by timer $T_{width}$, can be suitably adjusted according to the specifications (diameter, material, etc.) of the fastener being tightened.

If timer $T_{width}$ has not yet exceeded the predetermined value (NO in step S26), the process returns to step S22.

In summary, when an impact between hammer 4 and anvil 2 is detected, a first timer (e.g., $T_{width}$) is reset to zero and then started. If the next impact is not detected within the predetermined time of step S26, microcomputer 38 determines that the first detected impact occurred before the fastener reached the seated position and the process returns to step S14. Thereafter, when the next impact is detected, both the first and second timers (e.g., $T_{width}$ and $T_{auto}$) are reset and started again. Therefore, motor 22 will not be stopped because the second timer (i.e., $T_{auto}$) has exceeded the set value of step S22.

However, motor 22 is preferably automatically stopped after expiration of the set value (e.g., about 1 second). As noted above, timer $T_{auto}$ is not reset after an impact is detected that is determined to have occurred after the fastener reached the seated position. Thus, if timer $T_{auto}$ is not reset, because repeated impacts are detected that fall within $T_{width}$ the set value will provide sufficient time for the fastener to be tightened to the desired torque. Consequently, motor 22 of impact wrench 1 will be driven for a predetermined time (time set by setting device 34) after the fastener has reached the seated position. If an impart occurs before the fastener has reached the seated position (e.g., due to a burr or other imperfection in the fastener), the second timer (i.e., $T_{auto}$) is reset to zero. Further, such pre-seated position impact is not considered for the purpose of determining the period of time that motor 22 will be driven in order to sufficiently tighten the fastener. Naturally, the set value in step S22 can be changed by the operator or another person (e.g., using setting device 34) in order in change the amount of torque applied to the fastener.

Of course, the above representative embodiment is only one example of the present teachings and various modifications and improvements can be made without departing from the present teachings. For example, as briefly noted above, although motor 22 was stopped after a predetermined time had elapsed after the impact between the hammer 4 and anvil 2 is detected, motor 22 also could be stopped based upon a certain number of detected impacts. Various tightening tools utilize an "auto-stop" function that stops tho rotation of the motor 22 when the total number of impacts between hammer 4 and anvil 2 reaches a preset or predetermined number. The present teachings can be suitable applied to this type of tightening tools. For example, if an impact is detected and the microcomputer determines that the impact occurred before the fastener reached the seated position, the impact could be nullified (decrement the count by 1), or it could be utilized to reset the current count.

In addition, the first representative embodiment activated the auto-stop timer after detecting an impact and reset the auto-stop timer if the control device determined that the detected impact occurred before the fastener has reached the seated position. However, the auto-stop timer also could be activated after a detected impact is determined to have occurred after the fastener has reached the seated position. Thus, it would not be necessary to reset the auto-stop timer if an impact is determined to have occurred before the fastener reached the seated position. Therefore, the motor could be driven for a duration of time calculated by subtracting the amount of time, which is required to determine whether the impact has occurred after the fastener has reached the seated position, from the preset time.

Second Detailed Representative Embodiment

The tightening tool of the second embodiment does not determine whether the impact has occurred before or after the fastener has reached the seated position. Instead, the operating program of the tightening tool (i.e., automatic stopping condition) is not reset or adjusted, but rather the tightening tool can be easily switched to manual mode. Thereafter, the tightening tool can be manually operated to drive the motor until the fastener has reached the seated position.

The mechanical structure and the composition of the control circuit may be generally the same as the tightening tool of the first embodiment. Therefore, the same reference numerals will be used and the explanation of the same or similar parts may be omitted.

In the second representative embodiment, microcomputer 38 switches the operating mode set by the setting device 34 (hereafter called the normal mode) temporarily into manual mode by operating the main switch 48. A representative process for operating microcomputer 38 will be explained with reference to FIGS. 5 to 7. In the following explanation, the process steps for selecting the operating mode (i.e., switching the operating mode from normal mode to manual mode of from manual mode to normal mode) will first be explained. Thereafter, the process steps performed in each of the respective normal mode and manual mode will be explained.

Figure 5:
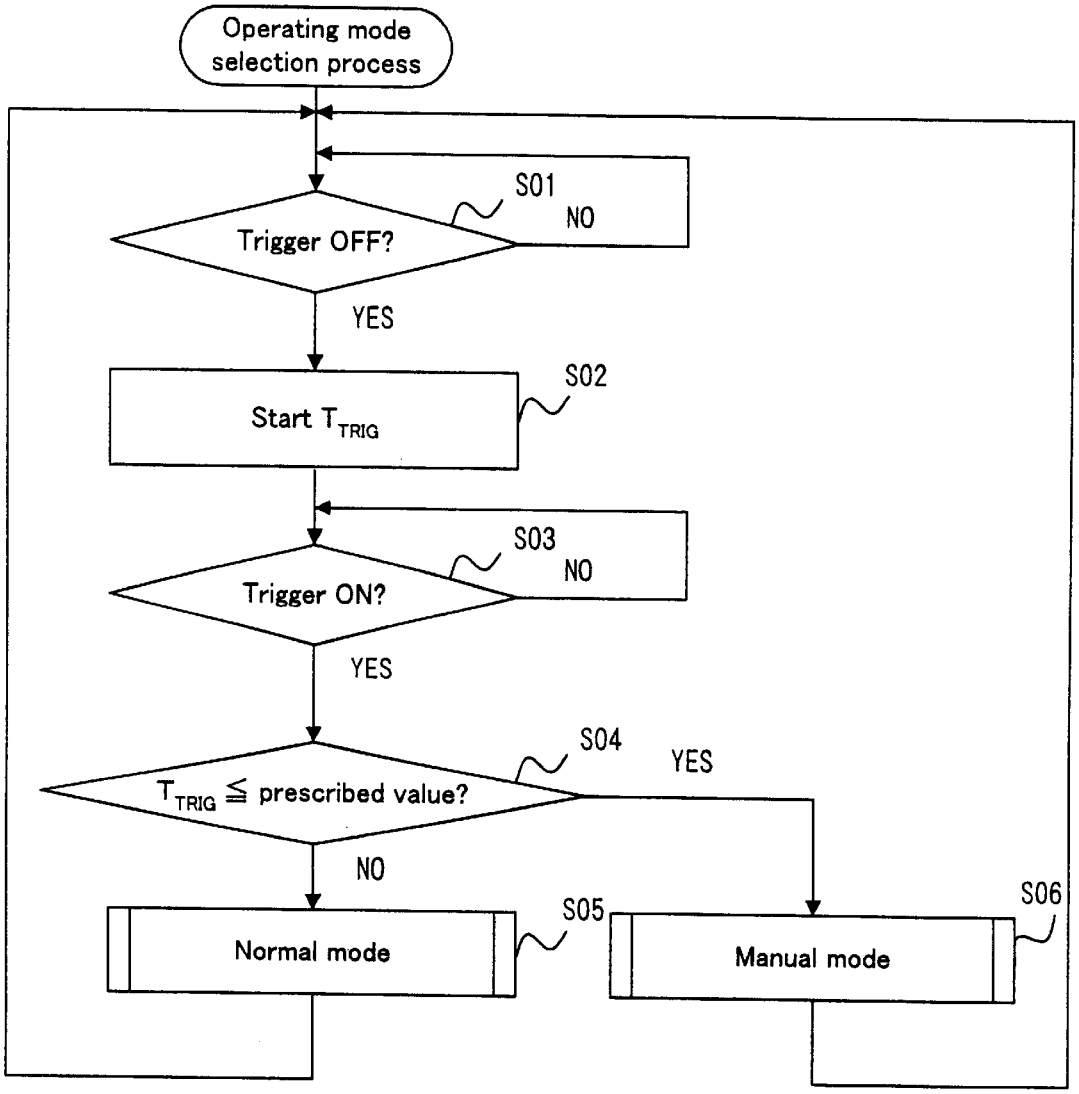
FIG. 5 shows a flowchart that explains the steps for switching the operating mode of the tightening tool of the second representative embodiment.

Referring to FIG. 5, microcomputer 38 first determines whether main switch 48 is disposed in the OFF position (step S01). For example, microcomputer 38 may determine whether main switch 48 is disposed in the OFF position based upon the electric potential across motor rotation direction switch 24 and switch 40, which are connected to microcomputer 38. If main switch 48 is not switched to the OFF position (NO in step S01) the process waits in standby mode until main switch 48 is switched to the OFF position. When main switch 48 is switched to the OFF position (YES in step S01), timer $T_{TRIG}$ is started (S02). Timer $T_{TRIG}$ counts the time interval between the time at which main switch 48 is switched to the OFF position and the time at which main switch 48 is switched back to the ON position.

When timer $T_{TRIG}$ is started microcomputer 38 then proceeds to determine whether main switch 48 has been switched to the ON position (step S03). If the main switch 48 has not been switched to the ON position (NO in step S03), the process waits in standby mode until main switch 48 is switched to the ON position. Naturally, timer TV continues to count while the process is in standby mode. When main switch 48 is switched to the ON position (YES in step S03), timer $T_{TRIG}$ is stopped and microcomputer 38 determines the time interval counted by timer $T_{TRIG}$. This calculated time interval is compared to a predetermined value (e.g., about 0.5) in step S04. If the calculated time interval is less than or equal to the predetermined time (YES in stop S04), the operating mode is switched to manual mode (step S06). On the other hand, if the calculated time interval exceeds the predetermined time (NO in step A), the operating mode is switched to the normal mode (step S05).

Thus, according to the second representative embodiment, when main switch 48 is switched to the OFF position and then switched back to the ON position within a predetermined time interval (e.g., within 0.5 second, the operating mode is set to manual mode. If the calculated time interval exceeds the predetermined time interval, the normal mode (e.g., auto-stop mode) will be utilized.

Figure 6:
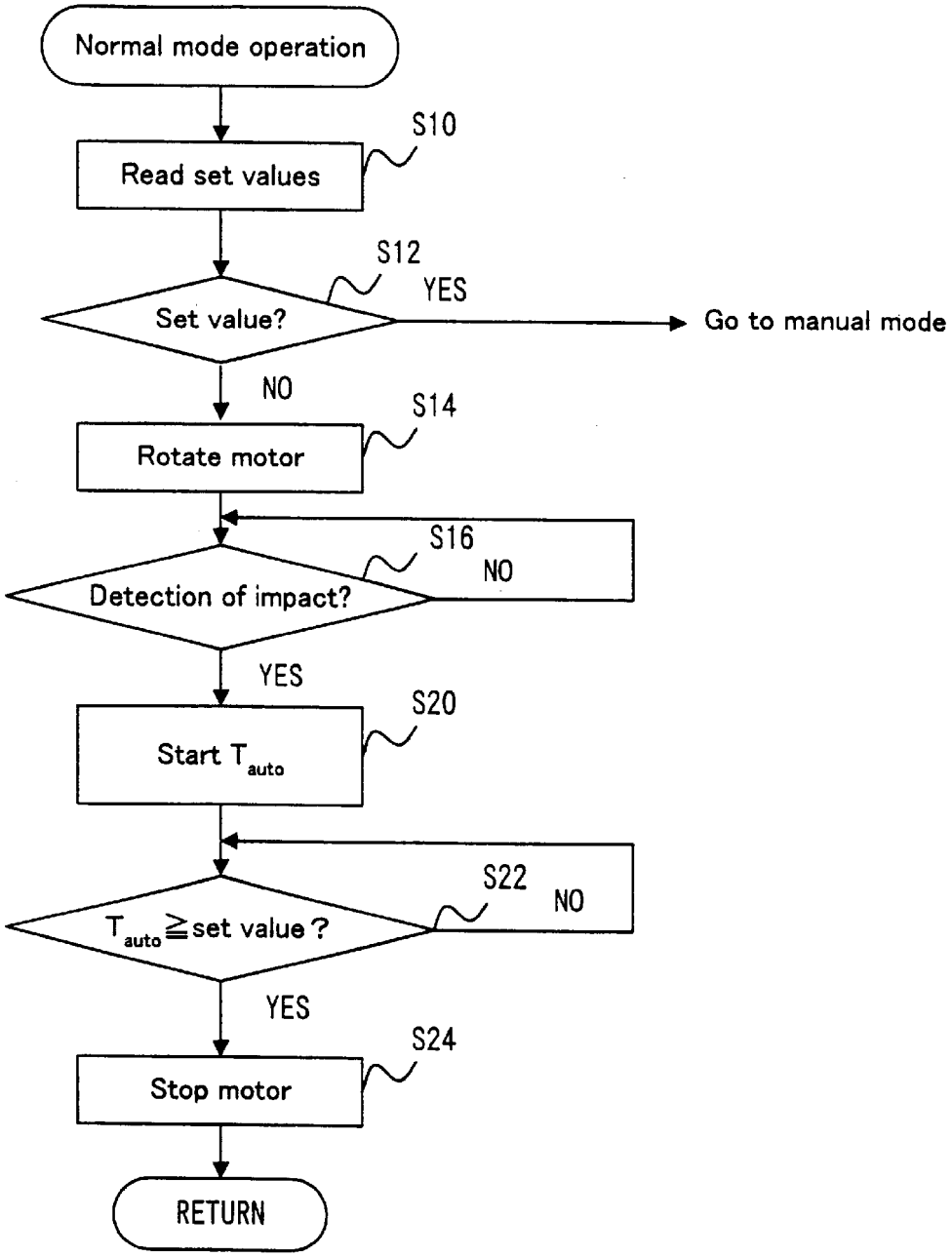
FIG. 6 shows a flowchart that explains the operation of the automatic stop mode.

FIG. 6 shows a representative process for operating power tool 1 in the normal (auto-stop) mode. For example, when main switch 48 is switched to the ON position, microcomputer 38 first reads the numerical value "XY" set on setting device 34 (step S10). Microcomputer 38 then determines whether the read numerical value is "00" (step S12). If setting device 34 indicates "00" (YES in step S12), the process transfers to manual mode processing (refer to FIG. 7). If setting device 34 indicates a value other than "00", motor 22 begins rotating due to a signal outputted by microcomputer 38 to switch 40 via the switching circuit 114 (step S14). In other words, when setting device 34 is set to any number other than "00", tightening tool 1 will operate in the automatic step mode in order to tighten the fastener.

Microcomputer 38 next determines whether an impact between hammer 4 and anvil 2 has been detected (step S16) if an impact between hammer 4 and anvil 2 has not been detected (NO in step S16), the process waits in standby mode until an impact between hammer 4 and anvil 2 is detected. Thus, when all impact between hammer 4 and anvil 2 is detected (YES in step S16), timer $T_{auto}$ is started (step S20). Thereafter, in step S22, microcomputer 38 repeatedly checks whether the counted time on timer $T_{auto}$ is greater than or equal to a set value (i.e., the numeral value "XY" set on setting device 34). Naturally, if the time counted by timer $T_{auto}$ has not yet exceeded the set value (NO in step S22) the process waits in standby mode until timer $T_{auto}$ does exceed the set value. Then, when the time counted by timer, $T_{auto}$ has exceeded the set value (YES in stop S22), motor 22 is stopped (step S24).

In the automatic stop mode shown in FIG. 6, the operator will switch main switch 48 to the OFF position after the rotation of motor 22 has stopped. By switching main switch 48 to the OFF position, the operating mode selection process shown in FIG. 5 will be started.

Figure 7:
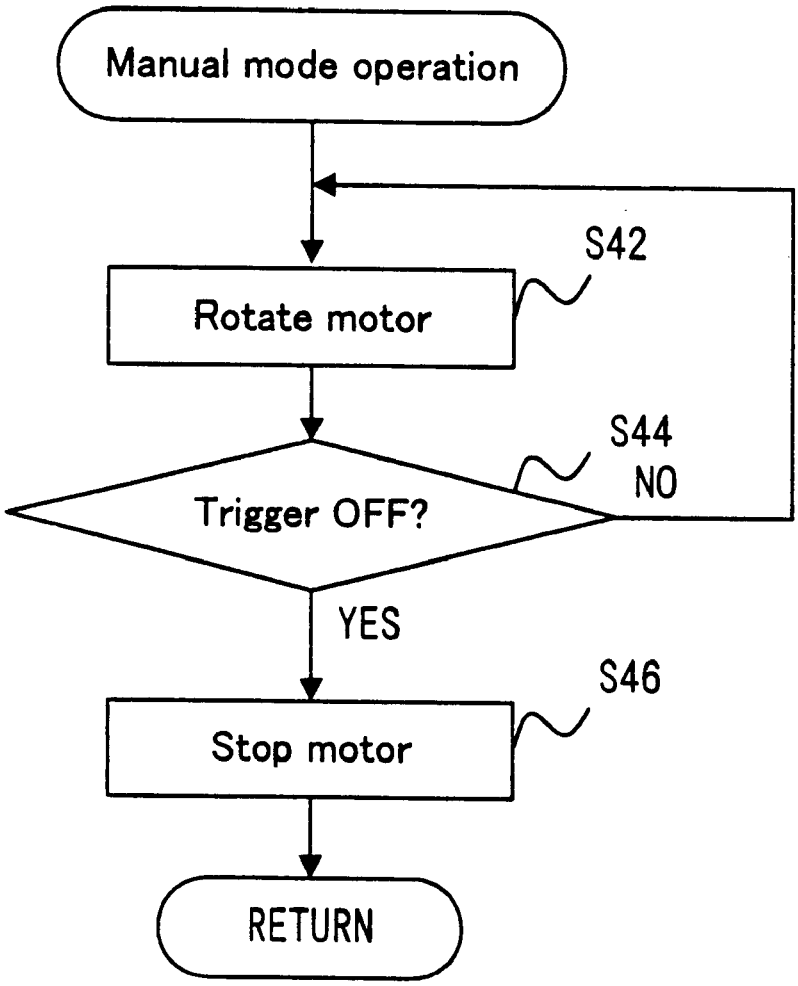
FIG. 7 shows a flowchart that explains the operation of the manual mode.

On the other hand, when the operating mode is switched to manual mode, the rotation of motor 22 is started by microcomputer 38 as shown in FIG. 7, because main switch 48 is already placed in the ON position (switched ON in step S03 of the operating mode selection process in FIG. 5) (step S42). Thus, according to the representative process shown in FIG. 7, when motor 22 starts to rotate, microcomputer 38 determines whether main switch 48 has been switched to the OFF position (stop S44). If the main switch 48 has not been switched to the OFF position (NO in step S44), the process waits in the same mode (i.e., motor 22 continues to rotate) until main switch 48 is switched to the OFF position. Then, when main switch 48 is switched to the OFF position (YES in step S44), the rotation of motor 22 is stopped (stop S46). Thus, as long as main switch 48 is continuously held in the ON position, motor 22 will be driven and the fastener will continue to be tightened.

Naturally, when main switch 48 is switched to the OFF position from the ON position, the operating mode selection process will be started because main switch 48 is disposed in the OFF position, which also happens in the manual mode.

In summary, in the tightening tool of the second representative embodiment, when main switch 48 is switched to the OFF position from the ON position, timer $T_{TRIG}$ is started. Then, if main switch 48 is switched back to the ON position within A determined time interval, the operating mode is switched to manual mode. If the main switch 48 is not switched back to the ON position within the predetermined time interval, the operating mode is switched to the normal mode (operating mode set by setting device 34). Consequently, if the operator desires to work using manual mode (e.g., when motor 22 has stopped rotating before the fastener has reached the seated position while working in automatic stop mode), tightening tool 1 can be switched to the manual mode without having to change the values set on setting device 34 (i.e., without having to change the preset operating conditions). In additions in order to switch to the manual mode, main switch 48 must be quickly switched to the ON position after it has been moved to the OFF tool is not likely to be switched to the manual mode during normal working conditions and unintentional switching to the manual mode by the operator can be prevented.

Furthermore, when the operating mode is switched to manual mode by operating main switch 48 as described above, the process for selecting the operating mode is started as soon as main switch 48 is placed in the OFF position after a fastening operation has been completed. Then, as long as main switch 48 is not switched back to the ON position within the predetermined time interval (e.g., 0.5 second), the operating mode reverts to the operating mode set using setting device 34. Consequently, unless the operator intentionally switches main switch 48 to the ON position, the operating mode reverts to the operating mode act using setting device 34 and continuation of the fastening operating in manual mode can be prevented.

The above described second representative embodiment provides an example of the application of the present teachings to a tightening tool in which the motor 22 stops running after a predetermined lime has elapsed after detection of the first impact between hammer 4 and anvil 2. However, the present teachings naturally can also be applied to other power tools in which the motor is driven according to a predetermined operating condition. For example, the present teachings can be applied to electric power tools such as screwdrivers or tightening tools, such as soft impact drivers or torque wrenches.

Thus, the present teachings can be applied to a screwdriver. For example, if a screw is tightened in a crooked manner, the screw may not properly seat on the workpiece. In this case, it will be necessary to loosen the tightened screw and retighten it correctly. The screw can be loosened by temporarily shifting the operation of the screw tightening mode into a reverse operating mode, and then return to the screw tightening mode in order to tighten the screw again without having to operate the motor rotation direction switch. Thus, the present teachings are especially applicable to such a situation.

In addition, in the second representative embodiment, the operating mode is switched to the manual mode when main switch 48 is switched from the ON position to the OFF position and hack to the ON position again within 0.5 seconds. However, the manual mode also can be selected only when certain additional conditions are met. For example, in order to switch from automatic stopping mode to manual mode, it may be required to operate main switch 48 after motor 22 has stopped according to the automatic stop mode (i.e., due to a signal from microcomputer 38) Using such an arrangement, when the operator switches main switch 48 to the OFF position and back to the ON position again for any reason while operating in the automatic stop mode, the operating mode will not switch from the automatic stop mode to manual mode. Consequently, accidental switching from automatic stop mode to manual mode can be prevented Further, the operating mode of the second embodiment is switched to the manual mode by operating main switch 48. However, the operating mode can also be switched by operating another switch. Thus, a selector switch (in addition to setting device 34 and main swatch 48) may also be provided so that the operating modes can be selected using this additional switch.

Furthermore, the operating mode selected by operating the selection means (e.g., main switch 48) is not limited in the manual mode. It can be established suitably in accordance with the functions and the nature of the work provided by the electric power tool.

Finally, although the first and representative embodiments have been described in terms of an impact wrench, the present teachings can naturally be applied to other impact tightening tools, such as soft-impact screwdrivers, or tightening tools that use impacts to generate elevated torque, For example, the increased torque can be generated by an oil pulse unit, which is commonly utilized in soft-impact screwdrivers, instead of a hammer and anvil. Oil pulse units typically emit a sound when the oil pulse unit is generating an elevated torque that will be applied to the fastener. For example, a sensor may be utilized to detect these impact sounds generated by the oil pulse unit and to convert impact sounds into impact signals, which arc then communicated to tho control device.

Furthermore, additional teachings concerning preferred tightening tools can be found in commonly-assigned U.S. patent application Ser. No. 09/811,370, which is incorporated by reference as if fully act forth herein.

What is claimed is:

1. A power tool adapted to tighten a fastener, comprising:

a drive source, means for generating an elevated torque operably coupled to the drive source, a sensor detecting when the means for generating an elevated torque has begun to operate and generate the elevated torque and a control device in communication with the sensor and the drive source, the sensor communicating signals to the control device when the means for generating an elevated torque has begun to operate and generate the elevated torque, wherein the control device determines whether the means for generating an elevated torque has begun to operate and generate the elevated torque either (1) before the fastener has reached a seated position against a workpiece or (2) after the fastener has reached the seated position against the workpiece, wherein the control device only controls the operation the drive source based upon signals generated by the sensor after the fastener has reached the seated position against the workpiece.

2. A power tool as in claim 1, wherein the means for generating an elevated torque comprises:

an anvil, and a hammer coupled to the drive source, the hammer being adapted to strike the anvil to thereby rotate the anvil and generate the elevated torque.

3. A power tool as in claim 1, wherein the means for generating an elevated torque comprises an oil pulse unit.

4. A power tool as in claim 1, wherein the control device starts a timer when the control device determines that the means for generating an elevated torque has begun to operate and generate an elevated torque after the fastener has reached the seated position against the workpiece, and stops the drive source when the timer reaches a pre-selected amount of time, and wherein the control device re-sets the timer to zero when the control device determines that the means for generating an elevated torque has begun to operate before the fastener has reached the seated position against the workpiece.

5. A power tool as in claim 4, wherein the control device determines that the fastener has reached the seated position against the workpiece by determining whether a first signal and a subsequent signal generated by the sensor have occurred within a pre-determined interval of time, wherein if the time between the signals is greater than the predetermined interval of time, the control device determines that the first signal occurred before the fastener has reached the seated position against the workpiece.

6. A power tool as in claim 1, wherein the control device starts a counter to count the number of signals generated by the sensor after the fastener has reached the seated position and stops the drive source when the a pre-determined number of signals have been counted, and wherein the control device re-sets the counter to zero when the control device determines that the means for generating an elevated torque has begun to operate before the fastener has reached the seated position against the workpiece.

7. A power tool as in claim 6, wherein the control device determines that the fastener has reached the seated position against the workpiece by determining whether a first signal and a subsequent signal generated by the sensor have occurred within a pre-determined interval of time, wherein if the time between the signals is greater than the pre-determined interval of time, the control device determines that the first signal occurred before the fastener has reached the seated position against the workpiece.

8. A power tool adapted to tighten a fastener, comprising;

a motor, a hammer rotatably driven by the motor, an anvil operably disposed to continuously contact and be driven by the hammer during a normal tightening operation and to be struck by the hammer when an elevated torque is generated, a sensor detecting impact sounds generated by the hammer striking the anvil in order to generate an elevated torque and a microprocessor in communication with the sensor and the motor, the sensor communicating detected impact signals to the microprocessor each time that the hammer strikes the anvil, wherein the microprocessor contains an operating program that determines, based upon the detected impact signals, whether each detected impact sound was generated either (1) before the fastener has reached a seated position against a workpiece or (2) after the fastener has reached the seated position against the workpiece, and wherein the microprocessor is further programmed to automatically stop the motor based only upon detected impact signals that are determined to have occurred after the fastener has reached the seated position against the workpiece.

9. A power tool as in claim 8, wherein the microprocessor is programmed to start a timer when the microprocessor determines that the hammer has struck the anvil after the fastener has reached the seated position against the workpiece, and stops the motor when the timer reaches a pre-selected amount of time, and wherein the microprocessor is further programmed to re-set the timer to zero when the microprocessor determines that the hammer has struck the anvil before the fastener has reached the seated position against the workpiece.

10. A power tool as in claim 9, wherein the microprocessor is programmed to determine that the fastener has reached the seated position against the workpiece by determining whether a first detected impact signal and a subsequent detected impact signal have occurred within a pre-determined interval of time, which pre determined interval of time is stored in the microprocessor, wherein if the time between the signals is greater than the pre-determined interval of time, the microprocessor determines that the first signal occurred before the fastener has reached the seated position against the workpiece.

11. A power tool as in claim 8, wherein the microprocessor is programmed to start a counter in order to count the number of detected impact signals after the fastener has reached the seated position and stops the motor when a pre-determined number of detected impact signals have been counted, the pre-determined number of detected impact signals being stored in the microprocessor, and wherein the microprocessor is programmed to re set the counter to zero when the microprocessor determines that the hammer has struck the anvil before the fastener has reached the seated position against the workpiece.

12. A power tool as in claim 11, wherein the microprocessor is programmed to determine that the fastener has reached the seated position against the workpiece by determining whether a first detected impact signal and a subsequent detected impact signal have occurred within a predetermined interval of time, which pre-determined interval of time is stored in the microprocessor, wherein if the time between the signals is greater than the pre-determined interval of time, the microprocessor determines that the first signal occurred before the fastener has reached the seated position against the workpiece.

13. A power tool comprising:

a drive source, a control device for controlling the drive source according to either a selected or a pre-determined operating mode, means for setting the selected operating mode, the setting means being in communication with the control device, a switch for switching the selected operating mode set by the setting means to the predetermined operating mode, wherein the control device drives the drive source in the predetermined operating mode when the switch is operated according to a predetermined condition, and the control device drives the drive source in the selected operating mode set by the setting means when the switch is not operated according to the predetermined condition.

14. A power tool as in claim 13, wherein the control device automatically returns to the operating mode set by the setting means after completing driving the drive source in the predetermined operating mode selected by the switch.

15. A power tool as in claim 14, wherein the switch is a trigger switch for energizing the drive source, and the control device selects the predetermined operating mode when the trigger switch is switched from the ON position to the OFF position in the predetermined condition, and the trigger switch is then switched back to the ON position again within a predetermined time period stored in the control device.

16. A power tool as in claim 15, wherein the control device selects the operating mode set by the setting device when the trigger switch is not switched back to the ON position within the pre-determined time period after having been switched from the ON position to the OFF position.

17. A power tool comprising:

a motor, means for generating an elevated torque coupled to the motor, a trigger switch for energizing the motor, a microprocessor controlling the motor according to either a manual operating mode or a normal auto-stop operating mode, which manual and normal auto-stop operating modes are stored in tho microprocessor, the microprocessor further comprising a timer for determining a time interval between the trigger switch being switched to an ON position after having been switched to the OFF position, wherein the microprocessor is programmed to control the motor (1) according to the normal auto-stop operating mode when the detected time interval is greater than a set time interval stored in the microprocessor and (2) according to the manual operating mode when the detected time interval is less than or equal to the set time interval stored in the microprocessor and a setting device in communication with the microprocessor, the setting device is capable of causing the microprocessor to switch from the normal auto-stop operating mode to the manual operating mode.

18. A power tool as in claim 17, wherein the microprocessor is programmed to automatically return to the normal auto-stop operating mode after completing driving the motor according to the manual operating mode.

* * * * *